United States Patent [19]

Busch et al.

[11] Patent Number: 4,867,183

[45] Date of Patent: Sep. 19, 1989

[54] DISPENSER FOR HAIR COSMETICS

[75] Inventors: Peter Busch, Erkrath; Klaus Thiele, Langenfeld, both of Fed. Rep. of Germany

[73] Assignee: Henkel Kommanditgesellschaft auf Aktien, Duesseldorf, Fed. Rep. of Germany

[21] Appl. No.: 270,416

[22] Filed: Nov. 8, 1988

Related U.S. Application Data

[63] Continuation of Ser. No. 068,984, Jul. 1, 1987, abandoned.

[30] Foreign Application Priority Data

Jul. 2, 1986 [DE] Fed. Rep. of Germany ..... 3622234

[51] Int. Cl.[4] ..... A45D 24/22

[52] U.S. Cl. ..... 132/110; 132/114

[58] Field of Search ..... 132/108, 109, 110, 111, 132/112, 114, 126, 142

[56] References Cited

U.S. PATENT DOCUMENTS

| | | | |
|---|---|---|---|
| 1,823,850 | 9/1931 | Marshall | 132/110 |
| 1,833,293 | 11/1931 | Laguionie | 132/142 |
| 2,170,550 | 8/1939 | Corel | 132/109 |
| 2,546,541 | 3/1951 | Hunt | 132/110 |
| 2,604,102 | 7/1952 | Laing | 132/110 |
| 2,608,976 | 9/1952 | Kittle et al. | 132/110 |
| 2,895,487 | 7/1959 | Hazzard | 132/110 |
| 3,101,086 | 8/1963 | Pivito | 132/114 |
| 3,262,459 | 7/1966 | Sheehan | 132/108 |
| 3,520,311 | 7/1970 | Iesersek et al. | 132/111 |
| 3,603,323 | 9/1971 | Avella | 132/11 R |
| 4,619,012 | 10/1986 | Wachtel | 132/11 R |

FOREIGN PATENT DOCUMENTS

| | | |
|---|---|---|
| 2600443 | 10/1976 | Fed. Rep. of Germany . |
| 2749074 | 5/1979 | Fed. Rep. of Germany . |
| 7932856 | 2/1980 | Fed. Rep. of Germany . |

*Primary Examiner*—Paul J. Hirsch

*Attorney, Agent, or Firm*—Ernest G. Szoke; Wayne C. Jaeschke; Real J. Grandmaison

[57] ABSTRACT

There is disclosed a dispenser for hair treating solution and the like in the form of a comb or brush having a hollow spine and teeth of absorbent material inserted therein in capillary-active communication with treatment solution in a reservoir in the spine, the flow of solution from the spine through the teeth to the hair being dependent solely on the quantity of solution applied to the hair through capillarly action. Spacers may also be provided to hold the teeth in spaced relation to the scalp.

10 Claims, 2 Drawing Sheets

DISPENSER FOR HAIR COSMETICS

This application is a continuation, of application Ser. No. 068,984, filed 7/1/87, now abandoned.

BACKGROUND OF THE INVENTION

1. Field of the Invention

This invention relates to a dispenser for hair cosmetics, and more particularly to a hair dye applicator in the form of a comb or brush having a hollow spine which can be provided with a supply of hair treatment solution and with teeth protruding from the spine to transfer the treatment solution onto the user's hair.

2. Description of Related Art

A dispenser in the form of a hair dye applicator is disclosed in German patent publication OS No. 27 49 074. As shown, the applicator has a hollow comb element which consists of a tube having hollow teeth extending substantially radially therefrom and connected to a reservoir that contains the hair dying solution. The hair dying solution is fed to the tube under pressure via a pressure-reducing valve. Because the quantity of solution fed to the teeth is determined primarily by the action of the pump, too much or too little of the solution can easily be applied. The teeth in the applicator are also surrounded by tufts of bristles, the tips of which project beyond the free ends of the associated teeth. The function of the bristles is to distribute the treatment solution uniformly over the hair. In the disclosed device, contact of the treatment solution with the scalp is virtually unavoidable if the hair is to be dyed close to the roots.

German patent publication GM No. 79 32 856 describes another hair dye applicator having comb teeth in which outer openings are provided in the reservoir for the treatment solution in the hollow spine of the comb. Each opening is formed at the base of the teeth between two adjacent teeth so that individual strands of hair can be drawn past the opening and the solution can thus be applied uniformly from the base to the tip of the strands. Although staining the scalp may largely be avoided with this device, it is very time-consuming to treat relatively large areas of the hair strand-by-strand.

BRIEF DESCRIPTION OF THE DRAWINGS

The invention is hereinafter described in detail with reference to the accompanying drawings wherein.

DESCRIPTION OF THE INVENTION

Figure 1:
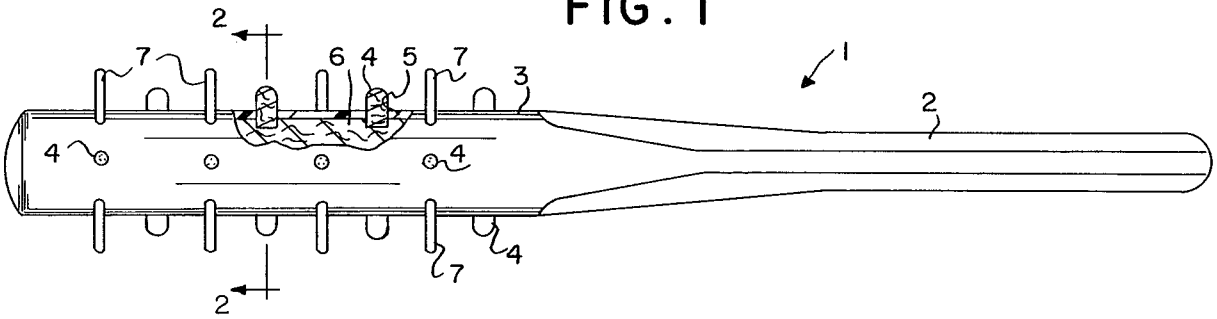
FIG. 1 is an elevational view, partly in section, of a dispenser in accordance with this invention.

One object of the present invention is to provide a dispenser for hair cosmetics in which the flow of liquid treatment solution is a function of the quantity of the treatment solution taken up by the hair.

Another object of the invention is to provide a dispenser that facilitates the application of particular solutions to the hair without affecting the scalp.

In accordance with this invention, these objects are achieved by providing a dispenser having a hollow spine with teeth employing an absorbent material which serves to deliver the treatment solution by capillary action from a reservoir within the spine to the outer surface of the teeth. The absorbent material can be a material having relatively large inner and outer surface areas such as a mass of compressed and consolidated fibrous material or a porous polymeric material. As used herein the expression "capillary-active communication" means that capillary action in the material from which the teeth are formed causes the treatment solution to flow from the reservoir in the spine through the teeth to the free ends thereof at a rate corresponding to the rate at which the treatment solution is deposited on the surface of the hair being treated. This mechanism is analogous to the operation of fiber-tip pens. The total amount of treatment solution applied to a treated area is the sum of amounts taken up by the individual treated strands. A mass of fibrous material or other porous material may also be used as filler in the spine of the comb or brush.

The liquid cosmetic hair treatment solution may be any of those commonly employed by consumers or beauticians, including for example, conditioners, lacquers, styling aids, bleaches, hair tints or hair dyes. While a uniform application of such solution to the hair cannot be obtained with a single fiber-tip pen, it is surprisingly possible to treat the hair uniformly by a relatively large number of fiber-tip pen type applicators in parallel in the form of a comb or brush.

Since the hair treatment solution, e.g. dye, is distributed from the surface of the teeth by contact through capillary forces, application of the treatment solution to the scalp will occur if care is not taken to avoid contact of the teeth or fiber tips with the scalp. According to another aspect of the invention, the avoidance of applying treatment solution to the scalp may be further facilitated by providing spacers on the dispenser which prevent the free ends of the teeth from coming into contact with the base of the hair or the scalp. The spacers are preferably in the form of pins which are arranged between and at a distance from the teeth, although they may also be integral with individual teeth, with several teeth or with all of the teeth. The spacers project beyond the free ends of the teeth so that when the dispenser is drawn through the hair with the spacers in contact with the scalp, the ends of the teeth are spaced from the scalp. At the same time, the difference in the length between the spacers and the teeth should be as small as possible to provide minimum clearance between the teeth and the scalp so that the individual strands of hair may be treated with the cosmetic solution as near as possible to the scalp.

The spine of the comb or brush dispenser of the present invention may comprise a replaceable cartridge containing a reservoir of the cosmetic hair treatment solution adapted to be connected to a permanent handle portion or, alternatively, the dispenser may be made with the handle and spine in one piece as herein shown which can be discarded after use.

Also in accordance with this invention, the comb or brush may be provided with two spines fixed to a single handle in which the two spines may contain different treatment solutions.

Figure 2A:
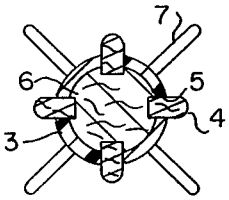
FIG. 2*a* is a sectional view similar to FIG. 2 illustrating an alternate arrangement of teeth.
Figure 2:
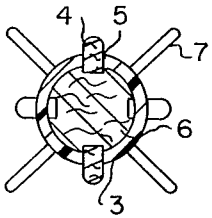
FIG. 2 is a sectional view transversely of the dispenser of FIG. 1 substantially on the line II—II.

With reference to FIGS. 1 and 2, there is shown a dispenser for hair cosmetic solutions comprising a brush 1 which includes a handle 2 and a spine 3 in the form of a hollow tube. Teeth 4 are inserted into openings 5 through the side wall of spine 3 into the hollow interior and project radially therefrom. As shown in the illustrated embodiment, there are four parallel, axial rows of teeth 4 extending lengthwise of spine 3 with each of the rows having four teeth.

Teeth 4 are formed of an absorbent material such as a compacted and consolidated mass of a fibrous material and are in capillary-active communication with a similar absorbent material 6 in hollow spine 3 of brush 1 that serves as the reservoir for the treatment solution. Optionally, handle 2 may also be hollow and filled with material 6, thus increasing the size of the reservoir of the treatment solution in the brush 1. The entire outer exposed surface, including the free end of each tooth 4, functions as an applicator surface.

To prevent the free ends of teeth 4 from coming into contact with the scalp and thus deposit treatment solution directly onto the scalp, there can be provided spacers 7 in the form of pins that may be formed integral with and extend radially from spine 3 a distance beyond the distal ends of teeth 4. Spacers 7, as shown, are disposed between and spaced from teeth 4. Spacers 7 are arranged in a plurality of sets of four spacers circumferentially arranged along a single radial plane at 90° intervals. The sets of spacers 7 are also arranged along the axis of spine 3 to form four axial rows of spacers 7. As shown in FIGS. 1 and 2, teeth 4 are arranged in sets of two circumferentially spaced teeth, with each set of teeth 4 arranged along a single radial plane at 180° intervals. The sets of teeth 4 are spaced along the axis of spine 3 such that sets are located alternately both along the radial plane of spacers 7 and intermediate the radial planes of axially adjacent sets of spacers 7. FIG. 2A illustrates an alternate arrangement of teeth 4 wherein the teeth are arranged in sets of four teeth circumferentially spaced at 90° intervals. The sets of four teeth are located at axial intervals in radial planes spaced from and between the radial planes of spacers 7.

Spacers 7 are only slightly longer than teeth 4 and serve to space the free ends thereof from the scalp when spacers 7 engage the scalp and thus prevent direct contact between the free ends of teeth 4 and the scalp.

Being relatively inexpensive, brush 1 may comprise a throw-away cartridge in which the solution is sold. To cover teeth 4 during storage or shipment, a transparent film for example can be provided over the same, spacers 7 serving to hold the film from the teeth and the solution being retained in the reservoir in spine 3 and teeth 4 by capillary action. The solution can also be supplied in a cartridge comprising the spine that is fitted into handle 2 for example, or from a separate container into spine 3 through openings in the end thereof.

Figure 3:
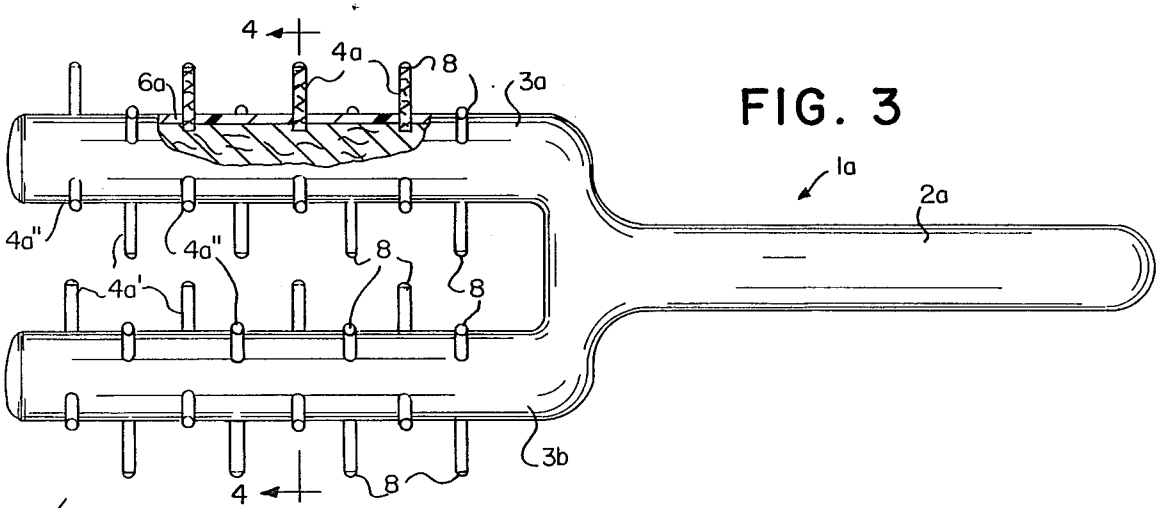
FIG. 3 is an elevational view, partly in section, similar to FIG. 1 showing an alternate embodiment of the invention in which there are two spines.
Figure 5:
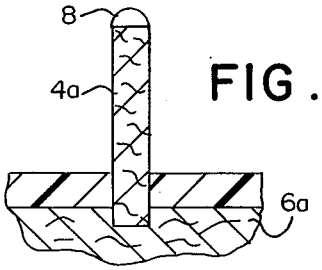
FIG. 5 is a fragmentary view in section and on an enlarged scale showing one of the teeth from the brush of FIG. 3.

In FIG. 3 there is shown an alternative embodiment of the dispenser of the present invention comprising brush 1*a* having a handle 2*a* and two spines 3*a* and 3*b* adapted to be filled with the absorbent material 6*a*. Spines 3*a* and 3*b* have teeth or bristles 4*a* which in principle are the same as teeth 4 but, in lieu of spacers 7 anchored between and at a distance from bristles 4*a*, there are provided spacers 8 fixed to the free ends of bristles 4*a*. Spacers 8 are formed of a material which does not exhibit capillary-active communication. The entire exposed outer surface of each tooth 4*a* up to spacer 8 functions as an applicator surface. This arrangement has the advantage that the spacing between the free ends of bristles 4*a* and the scalp can be reduced to a minimum since, even when the free ends of bristles 4*a* are stressed and thus bent, spacers 8 still serve to hold the ends thereof off the scalp.

Another advantage of the dispenser shown in FIG. 3 is that the two parallel spines 3*a* and 3*b* can be adapted to supply different treatment solutions.

Figure 4:
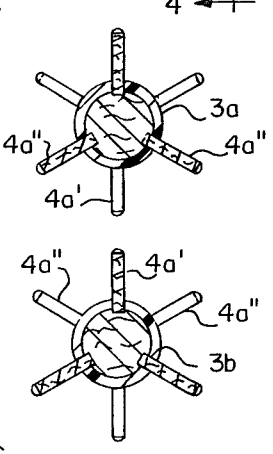
FIG. 4 is a sectional view transversely of the dispenser of FIG. 3 substantially on the line IV—IV.

Bristles 4*a* are arranged on spines 3*a* and 3*b* in sets of three bristles circumferentially spaces at 120° intervals. Each set of three bristles 4*a* is located along a single radial plane and the sets are spaced along the axes of spines 3*a* and 3*b*. As best seen in FIG. 4, axially adjacent sets of bristles 4*a* are rotated 60° out of alignment, so that two sets of axial adjacent bristles 4*a* locate the bristles at 60° intervals. The sets of bristles 4*a* are also arranged so that pairs of sets are aligned on a plurality of common radial planes extending through both spines 3*a* and 3*b*. Again as best seen in FIG. 4, each pair of the sets of teeth 4*a*, which is aligned on a common plane, has teeth 4*a* arranged so the tooth 4*a* extending directly toward an opposite spine is located intermediate two teeth 4*a*″ extending from the opposite spine.

Although certain embodiments of the invention have been described in detail, it will be appreciated that other embodiments are contemplated along with modifications of the disclosed features, as being within the scope of the invention, which is defined in the appended claims.

The following U.S. Pat. Nos. disclose hair treating liquids/creams of the type which may be used in the inventive applicators, all of which patents are incorporated herein by reference: 4,552,565; 4,575,377; 4,629,466; 4,487,607; 4,371,370; 4,322,212; 4,325,704; 4,314,809; 4,226,595; 4,217,758; 4,129,413; 4,129,414; and Re. No. 30,199. Of the foregoing, compositions disclosed in U.S. Pat. Nos. 4,314,809; 4,217,758; and Re. No. 30,199 are most useful, particularly those disclosed in Example 5 of 4,314,809.

We claim:

1. A dispenser for a hair treatment solution comprising a spine providing a reservoir for receiving a treatment solution, said spine having a plurality of openings in the side wall thereof, capillary teeth inserted into said openings into direct communication with the treatment solution in said reservoir, said teeth consisting of an absorbent material which directly absorbs, retains and delivers the solution by capillary attraction from said reservoir directly to an outer applicator surface of said teeth comprising the entire exposed surface thereof, and a plurality of non-absorbent spacers supported by said spine and extending to a height greater than the height of the applicator surface of said capillary teeth in order to contact the scalp and prevent the applicator surface of said teeth from contacting the scalp during the step of dispensing said hair treatment solution from said applicator surface directly to the hair whereby the flow of hair treatment solution from the reservoir is a function of the quantity of the treatment solution taken up by the hair.

2. A dispenser as claimed in claim 1 in which said spine is provided with an absorbent material for receiving said treatment solution.

3. A dispenser as claimed in claim 2 in which said teeth are arranged in parallel rows lengthwise of said spine and spaced angularly about said spine.

4. A dispenser as claimed in claim 1 in which the spacers are in the form of pins mounted on the spine and projecting beyond the free ends of the teeth.

5. A dispenser as claimed in claim 4 in which said spacers are arranged generally between and at a distance from said teeth.

6. A dispenser as claimed in claim 1 in which said spacers are fixed to the free ends of said teeth.

7. A dispenser as claimed in claim 1 in which two spines adapted to contain different treatment solutions are fixed in parallel relation to one another.

8. A dispenser as claimed in claim 1 in which said teeth are formed of a compacted and consolidated fibrous material.

9. A dispenser as claimed in claim 1 having a handle and in which said spine comprises a replaceable cartridge of the treatment solution adapted to be fitted to said handle.

10. A dispenser as claimed in claim 1 having a handle and in which said spine and said handle are made in one piece.

* * * * *